US008427162B2

(12) United States Patent
Bespalov et al.

(10) Patent No.: US 8,427,162 B2
(45) Date of Patent: Apr. 23, 2013

(54) APPARATUS AND METHOD FOR DETECTION OF POSITION OF A COMPONENT IN AN EARTH FORMATION

(75) Inventors: Alexandre N. Bespalov, Spring, TX (US); Vladimir Dubinsky, Houston, TX (US); Rashid W. Khokhar, Sugar Land, TX (US)

(73) Assignee: Baker Hughes Incorporated, Houston, TX (US)

( * ) Notice: Subject to any disclaimer, the term of this patent is extended or adjusted under 35 U.S.C. 154(b) by 554 days.

(21) Appl. No.: 12/545,505

(22) Filed: Aug. 21, 2009

(65) Prior Publication Data

US 2010/0044108 A1 Feb. 25, 2010

Related U.S. Application Data

(63) Continuation-in-part of application No. 12/197,411, filed on Aug. 25, 2008, now Pat. No. 8,278,928.

(51) Int. Cl.
*G01V 3/08* (2006.01)

(52) U.S. Cl.
USPC ..... 324/326

(58) Field of Classification Search ..... None
See application file for complete search history.

(56) References Cited

U.S. PATENT DOCUMENTS 5,273,111 A 12/1993 Brannan et al.
5,419,405 A * 5/1995 Patton ..... 175/27
5,508,616 A 4/1996 Sato et al.
5,541,517 A 7/1996 Hartmann et al.
6,100,696 A 8/2000 Sinclair
6,662,872 B2 12/2003 Gutek et al.
6,927,741 B2 * 8/2005 Brune et al. ..... 324/334
7,209,093 B2 * 4/2007 Brune et al. ..... 324/334
7,443,359 B2 * 10/2008 Brune et al. ..... 324/328
7,568,532 B2 * 8/2009 Kuckes et al. ..... 175/40
7,714,585 B2 5/2010 Nikitenko et al.
7,898,494 B2 3/2011 Brune et al.
2002/0105333 A1 8/2002 Amini
2003/0016020 A1 1/2003 Gianzero
2003/0051914 A1 3/2003 Bittar
2004/0140811 A1 * 7/2004 Conti ..... 324/338
2004/0239329 A1 * 12/2004 Haber et al. ..... 324/339

(Continued)

OTHER PUBLICATIONS

Restarick, H., "Horizontal Completion Options in Reservoirs with Sand Problems". SPE 29831. SPE Middle East Oil Show held in Bahrain, Mar. 11-14, 1995. pp. 545-560.

(Continued)

*Primary Examiner* — Jermele M Hollington
(74) *Attorney, Agent, or Firm* — Cantor Colburn LLP

(57) ABSTRACT

An apparatus for detecting a position of a component in an earth formation is disclosed. The apparatus includes: a transmitter configured to emit a first magnetic field into the earth formation and induce an electric current in the component, the transmitter having a first magnetic dipole extending in a first direction; and a receiver for detecting a second magnetic field generated by the component in response to the first magnetic field, the receiver having a second magnetic dipole extending in a second direction orthogonal to the first direction. A method and computer program product for detecting a position of a component in an earth formation is also disclosed. Apparatus and methods are also disclosed for estimating a position of a second borehole being drilled relative to an existing first borehole.

16 Claims, 8 Drawing Sheets

U.S. PATENT DOCUMENTS

| | | | | |
|---|---|---|---|---|
| 2005/0140373 | A1 | 6/2005 | Li et al. | |
| 2006/0192562 | A1 | 8/2006 | Davydychev et al. | |
| 2007/0126426 | A1 | 6/2007 | Clark et al. | |
| 2007/0176842 | A1 | 8/2007 | Brune et al. | |
| 2007/0256830 | A1 * | 11/2007 | Entov et al. | 166/250.1 |
| 2007/0278008 | A1 | 12/2007 | Kuckes et al. | |
| 2008/0143336 | A1 | 6/2008 | Legendre et al. | |
| 2008/0197851 | A9 | 8/2008 | Forgang et al. | |
| 2009/0091328 | A1 | 4/2009 | Clark et al. | |

OTHER PUBLICATIONS

Henry Restarick. "Horizontal Completion Options in Reservoirs with Sand Problems". SPE 29831. Mar. 11-14, 1995. pp. 545-560.

* cited by examiner 108
107
109
110
111
14
2
12
101
112
102
16
107
106
104
100, 42
105
103

*Fig.* 9
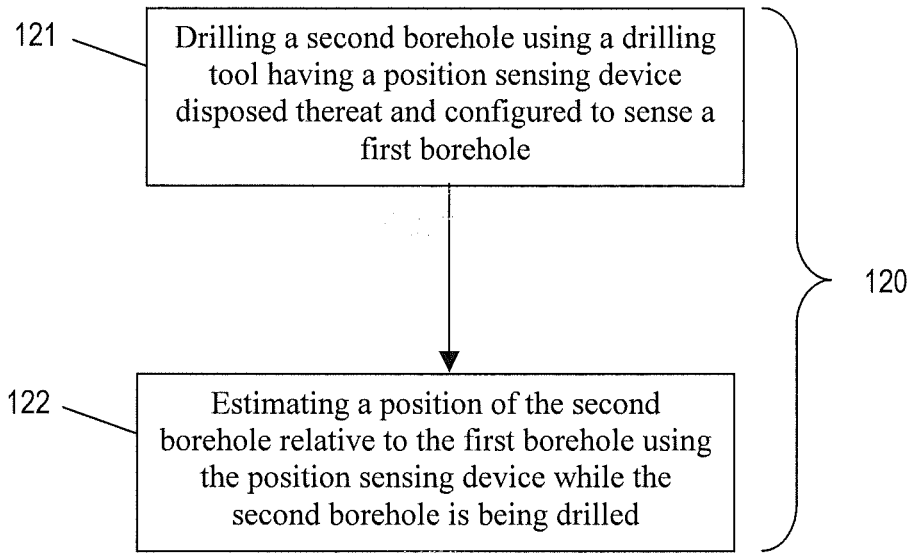

APPARATUS AND METHOD FOR DETECTION OF POSITION OF A COMPONENT IN AN EARTH FORMATION

CROSS REFERENCE TO RELATED APPLICATION

This application is a continuation in part application of U.S. Ser. No. 12/197,411, filed Aug. 25, 2008, the contents of which are incorporated by reference herein in their entirety.

BACKGROUND

Geologic formations below the surface of the earth may contain reservoirs of oil and gas, which are retrieved by drilling one or more boreholes into the subsurface of the earth. The boreholes are also used to measure various properties of the boreholes and the surrounding subsurface formations.

Oil and gas retrieval and measurement processes often involve the use of multiple boreholes. Multiple boreholes are useful, for example, in maximizing oil and gas retrieval from a formation and establishing sensor arrays for formation evaluation (FE) purposes.

An example of a multiple borehole oil and gas retrieval system is a Steam Assisted Gravity Drainage (SAGD) system that is used for recovering heavy crude oil and/or bitumen from geologic formations, and generally includes heating the bitumen through an injection borehole until it has a viscosity low enough to allow it to flow into a parallel recovery borehole. As used herein, "bitumen" refers to any combination of petroleum and matter in the formation and/or any mixture or form of petroleum, specifically petroleum naturally occurring in a formation that is sufficiently viscous as to require some form of heating or diluting to permit removal from the formation.

Generally, implementation of a multiple borehole system includes detecting a location of a first borehole when drilling a second borehole in order to avoid contact between the boreholes and/or accurately position the boreholes relative to one another. Such detection may involve the use of antennas that act as transmitters and receivers to interrogate an earth formation. Examples of such antennas include so-called "slot" design antennas, such as "Z-type" antennas ("Z-antennas") typically used in multi-frequency and multi-spacing propagation resistivity ("MPR") tools and "X-type" antennas ("X-antennas") typically used in azimuth propagation resistivity ("APR") tools. Accurate detection of borehole position can be difficult, as direct coupling of measurement signals between measurement transmitters and receivers can overshadow measurement signals.

SUMMARY

Disclosed herein is an apparatus for detecting a position of a component in an earth formation. The apparatus includes: a transmitter configured to emit a first magnetic field into the earth formation and induce an electric current in the component, the transmitter having a first magnetic dipole extending in a first direction; and a receiver for detecting a second magnetic field generated by the component in response to the first magnetic field, the receiver having a second magnetic dipole extending in a second direction orthogonal to the first direction.

Also disclosed herein is a method of detecting a position of a component in an earth formation. The method includes: drilling a first wellbore and disposing therein an electrically conductive component; drilling a second wellbore parallel to the first wellbore and disposing therein a downhole tool, the downhole tool including a transmitter having a first magnetic dipole extending in a first direction, the receiver having a second magnetic dipole extending in a second direction orthogonal to the first direction; transmitting a first magnetic field from the transmitter to induce an electric current in the component and an associated second magnetic field; and detecting the second magnetic field by a receiver and calculating at least one of a direction and a distance of the component therefrom.

Further disclosed herein is a computer program product stored on machine-readable media for detecting a position of a component in an earth formation. The product includes machine-executable instructions for: drilling a second wellbore parallel to a first wellbore and disposing therein a downhole tool, the first wellbore including an electrically conductive component therein, the downhole tool including a transmitter having a first magnetic dipole extending in a first direction, the receiver having a second magnetic dipole extending in a second direction orthogonal to the first direction; transmitting a first magnetic field from the transmitter to induce an electric current in the component and an associated second magnetic field; and detecting the second magnetic field by a receiver and calculating at least one of a direction and a distance of the component therefrom.

Further disclosed is a method for estimating a position of a second borehole relative to an existing first borehole, the method including: conveying a position sensing device with a drilling tool in the second borehole, the position sensing device being configured to sense the first borehole; and estimating the position of the second borehole relative to the first borehole using the position sensing device.

Further disclosed is a method for estimating a position of a second borehole relative to a first borehole, the method including: conveying a carrier having a position sensing device disposed thereat through the second borehole; transmitting a first signal from the position sensing device towards the first borehole; receiving a second signal with the position sensing device in response to the first signal; and estimating the position of the second borehole relative to the first borehole using the second signal; wherein the first signal and the second signal comprise at least one of electromagnetic energy and electric current.

Further disclosed is an apparatus for estimating a position of a second borehole relative to a first borehole, the apparatus including: a carrier configured for being conveyed through the second borehole; and a position sensing device disposed at the carrier and configured to sense the first borehole to estimate the position of a second borehole relative to the first borehole; wherein the position sensing device emits and receives signals having at least one of electromagnetic energy and electric current to sense the first borehole.

BRIEF DESCRIPTION OF THE DRAWINGS

The following descriptions should not be considered limiting in any way. With reference to the accompanying drawings, like elements are numbered alike:

FIG. 9 depicts a flow chart providing an exemplary method of estimating a position of the second borehole relative to the first borehole.

DETAILED DESCRIPTION

A detailed description of one or more embodiments of the disclosed apparatus and method are presented herein by way of exemplification and not limitation with reference to the Figures.

There is provided an apparatus and method for detecting a position of a component in an earth formation, such as a component of a drillstring or a downhole tool disposed in a borehole. The system and method may be incorporated in any formation production and/or evaluation system that incorporates multiple boreholes. The apparatus includes a transmitter for emitting a first magnetic field into the earth formation and induce an electric current in the component, and a receiver for detecting a second magnetic field generated by the component in response to the first magnetic field. The transmitter has a first magnetic dipole extending in a first direction, and the receiver has a second magnetic dipole extending in a second direction orthogonal to the first direction.

Figure 1:
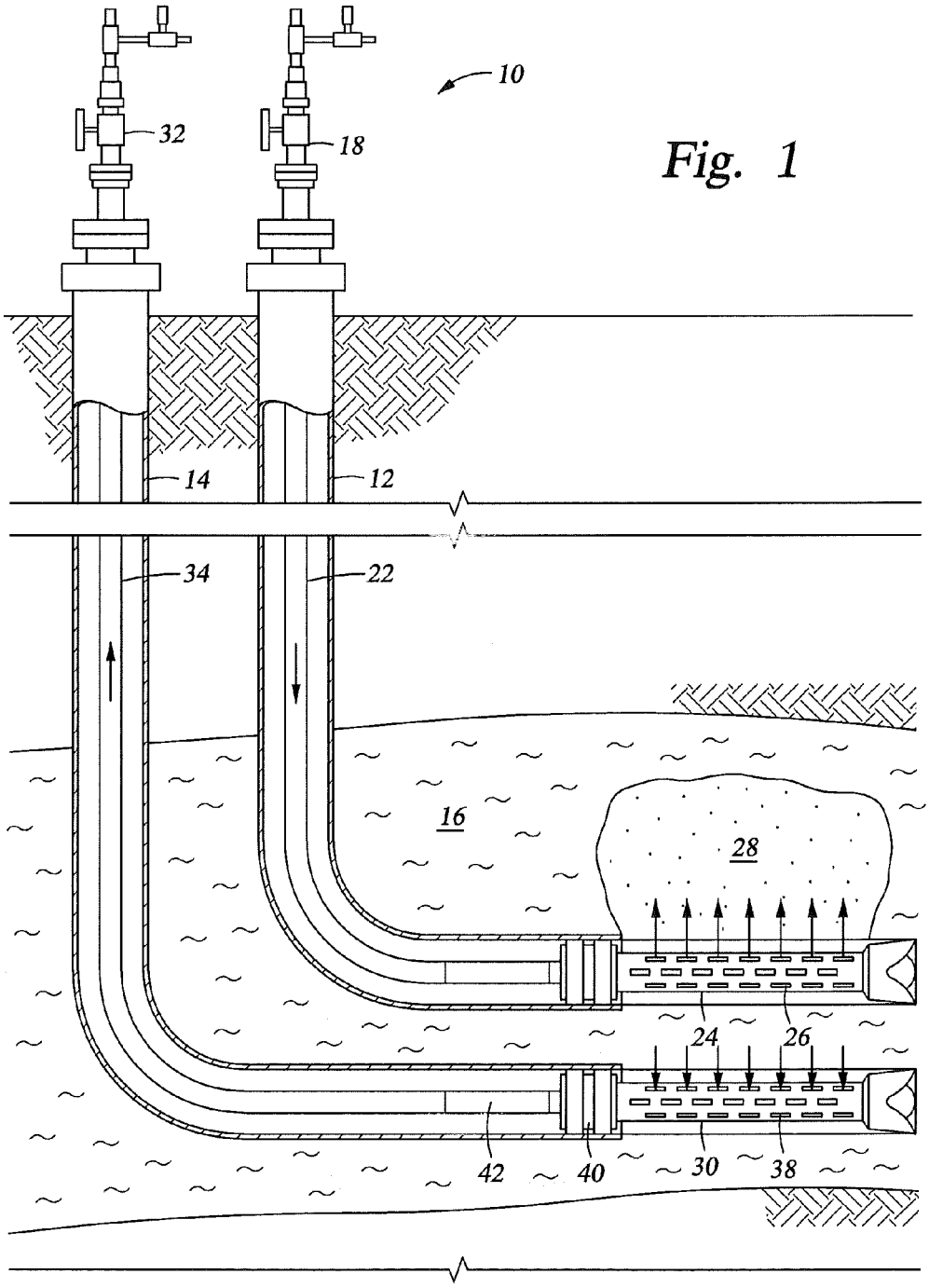
FIG. 1 depicts an exemplary embodiment of a formation production system.

Referring to FIG. 1, an example of a multiple borehole system is a formation production system 10 that includes a first borehole 12 and a second borehole 14 extending into an earth formation 16. In one embodiment, the formation includes bitumen and/or heavy crude oil. As described herein, "borehole" or "wellbore" refers to a single hole that makes up all or part of a drilled borehole. As described herein, "formations" refer to the various features and materials that may be encountered in a subsurface environment. Accordingly, it should be considered that while the term "formation" generally refers to geologic formations of interest, that the term "formations," as used herein, may, in some instances, include any geologic points or volumes of interest. The system 10 described herein is merely exemplary, as the apparatus and method may be utilized with any multiple borehole system.

The first borehole 12 includes an injection assembly having an injection valve assembly 18 for introducing steam from a thermal source (not shown), an injection conduit 22 and an injector 24. The injector 24 receives steam from the conduit 22 and emits the steam through a plurality of openings such as slots 26 into a surrounding region 28. Bitumen in region 28 is heated, decreases in viscosity, and flows substantially with gravity into a collector 30.

A production assembly is disposed in the second borehole 14, and includes a production valve assembly 32 connected to a production conduit 34. After the region 28 is heated, the bitumen flows into the collector 30 via a plurality of openings such as slots 38, and flows through the production conduit 34, into the production valve assembly 32 and to a suitable container or other location (not shown).

In this embodiment, both the injection conduit 22 and the production conduit 34 are hollow cylindrical pipes, although they may take any suitable form sufficient to allow steam or bitumen to flow therethrough. Also in this embodiment, at least a portion of boreholes 12 and 14 are parallel horizontal boreholes.

In one embodiment, the injection conduit 22 and/or the production conduit 34 are configured as a drillstring and include a drill bit assembly. In another embodiment, the drillstring includes a steering assembly 40 connected to the drill bit assembly and configured to steer the drill bit and the drillstring through the formation.

A downhole measurement tool 42 is disposed in the borehole 12 and/or the borehole 14. In one embodiment, the tool 42 is disposed within the injection conduit 22 and/or the production conduit 34. In one embodiment, one or more of the conduits 22, 34 are incorporated into a respective drillstring connected to the drilling assembly.

Figure 2:
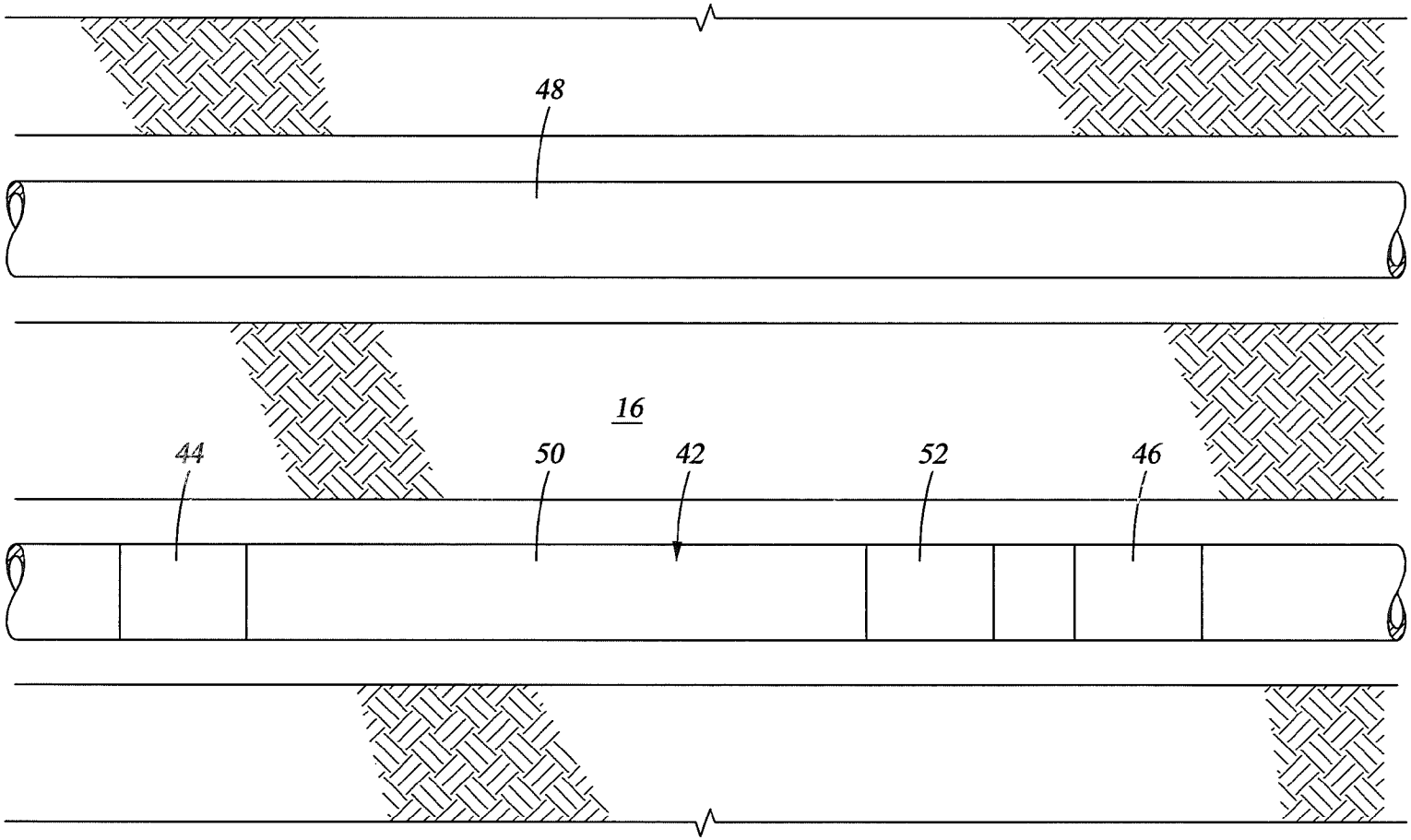
FIG. 2 depicts an exemplary embodiment of a downhole tool.

Referring to FIG. 2, the tool 42 includes at least one transmitter 44 and at least one receiver 46. The transmitter 44 and the receiver 46 are mutually orthogonal. The transmitter 44 is configured to emit a first magnetic field into the formation 16 and induce an electric current in a component 48 such as a drillstring or conduit located in another wellbore. The first magnetic field has a dipole in a first direction. The receiver 46 is configured to receive a second magnetic field and has a second dipole in a second direction that is orthogonal to the first direction of the first dipole. In one embodiment, the dipoles of both the transmitter 44 and the receiver 46 are orthogonal to a direction of a major axis of the borehole 12, 14. In one embodiment, the transmitter 44 and the receiver 46 are electrically conductive coils configured to transmit and/or receive magnetic fields. In one embodiment, the transmitter 44 and the receiver 46 are disposed on or in an elongated body 50 such as a mandrel or a housing. In one embodiment, the elongated body is made from a metallic material.

As referred to herein, a "Z" direction is a direction parallel to the major axis of the borehole. An "X" direction is a direction orthogonal to the Z direction, and a "Y" direction is a direction orthogonal to both the X and the Z direction. The naming convention described herein is merely exemplary and non-limiting.

In the example shown in FIG. 2, the elongated body 50 is a metal mandrel having a diameter of approximately six inches, and the transmitter 44 and the receiver 46 are separated by a distance in the Z-direction of approximately one meter. Each of the transmitter 44 and the receiver 46 are placed inside a system of transverse trenches filled with a ferrite material. For example, each of the transmitter 44 and the receiver 46 are placed inside a system of ten transverse trenches, each trench being ⅛ inch wide, ¼ inch deep and spaced ⅛ inch apart of each other and filled with a ferrite having a magnetic permeability "μ" of 125. In this example, the transmitter 44 is a coil having one turn, and the receiving transmitter 46 is a coil having three turns. An exemplary excitation current, applied to the transmitter 44 to generate a magnetic field, is two amps. The dimensions and distances described herein are exemplary, as the tool 42 may be configured to have any suitable dimensions.

In one embodiment, an optional additional receiver 52 is included in the tool 42 and is configured as a bucking coil. The bucking coil 52 is disposed on the tool 42 between the transmitter 44 and the receiver 46. The bucking coil 52 has a first polarity that is opposite a second polarity of the receiver 46. The bucking coil 52 is configured to reduce or eliminate direct coupling between the transmitter 44 and the receiver 46, which can be much larger than the signal received from the remote pipe 48. In one embodiment, the bucking coil 52 and the receiver 46 coils are physically connected resulting in effectively a single coil, or are separately disposed in the tool 42.

In one embodiment, the tool 42 is configured as a downhole logging tool. As described herein, "logging" refers to the taking of formation property measurements. Examples of logging processes include measurement-while-drilling (MWD) and logging-while-drilling (LWD) processes, during which measurements of properties of the formations and/or the borehole are taken downhole during or shortly after drilling. The data retrieved during these processes may be transmitted to the surface, and may also be stored with the downhole tool for later retrieval. Other examples include logging measurements after drilling, wireline logging, and drop shot logging. As referred to herein, "downhole" or "down a borehole" refers to a location in a borehole away from a surface location at which the borehole begins.

In one embodiment, the tool 42 includes suitable communications equipment for transmitting data and communication signals between the tool 42 and a remote processor. The communications equipment may be part of any selected telemetry system, such as a wireline or wired pipe communication system or a wireless communication system including mud pulse telemetry and/or RF communication.

In one embodiment, the tool 42 includes a processor or other unit disposed on or in the tool 42. The processor and the surface processing unit include components as necessary to provide for storage and/or processing of data from the tool 42. Exemplary components include, without limitation, at least one processor, storage, memory, input devices, output devices and the like. As these components are known to those skilled in the art, these are not depicted in any detail herein.

Figure 3:
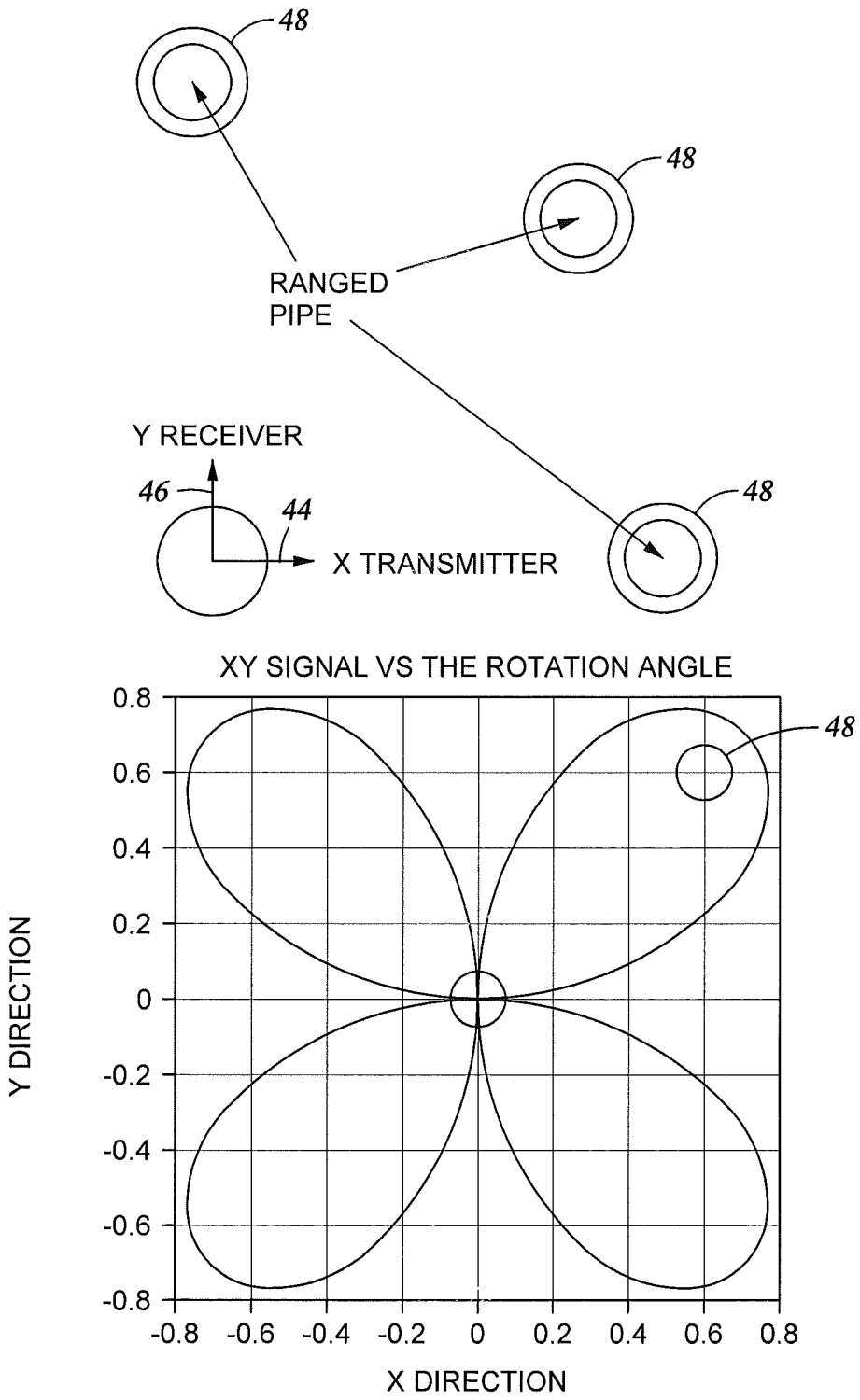
FIG. 3 depicts exemplary positions of boreholes relative to the downhole tool of FIG. 2.
Figure 4:
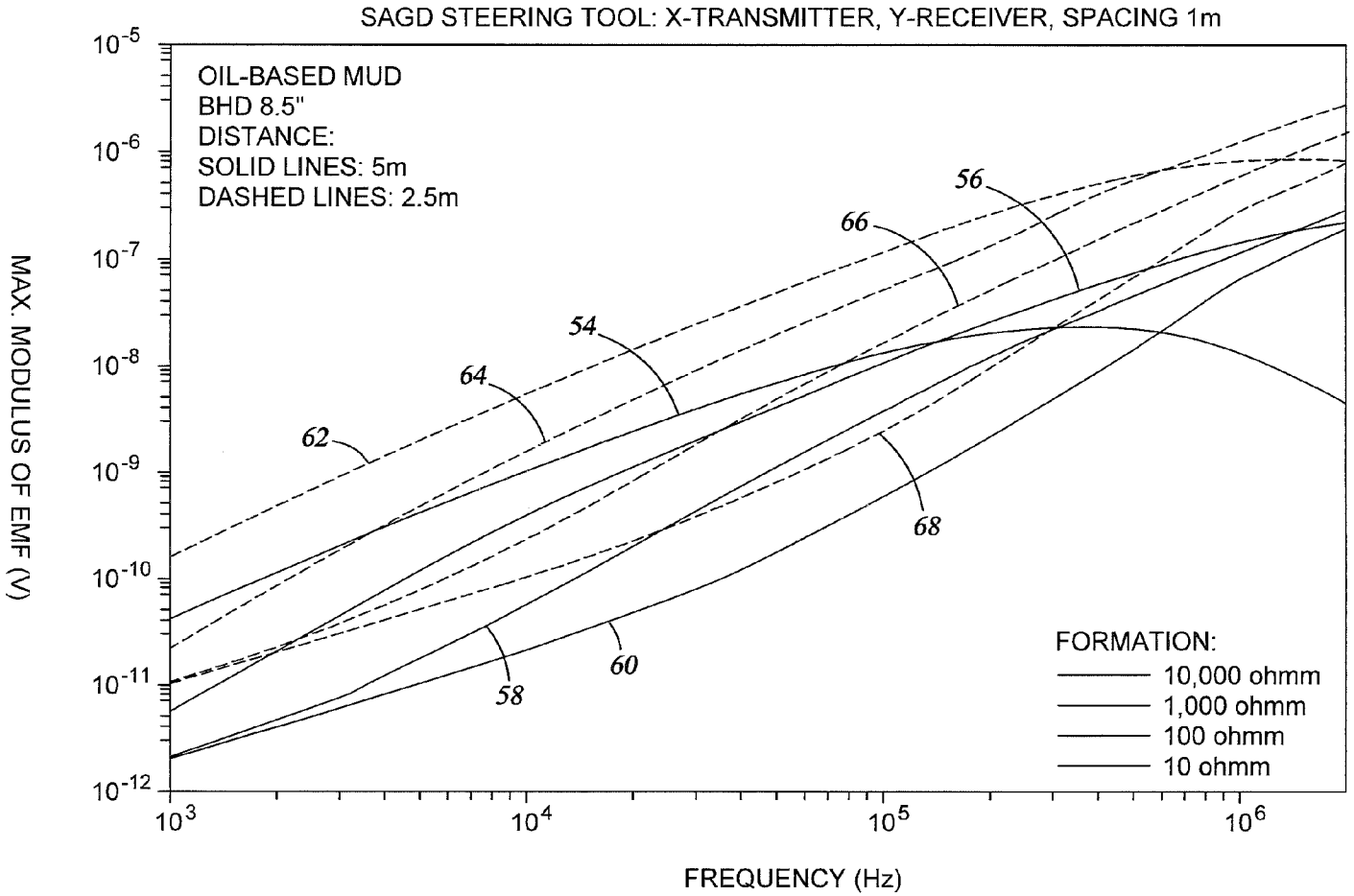
FIG. 4 depicts signal values for exemplary component distances.

Referring to FIGS. 3 and 4, exemplary measurements using the tool 40 to locate the remote pipe 48 are shown. Specifically, the measured modulus of electromotive force is shown for exemplary distances. As shown, in addition to being dependent on frequency and formation resistivity, the measured modulus of electromotive force (EMF) is dependent on the distance between the signal source (e.g., the remote pipe 48) and the receiver 46, and on the angle between the direction towards the remote pipe 48 and the receiver direction, i.e., the direction of the receiver dipole. The signal "S" represents the modulus of EMF for the transmitter 44 and the receiver 46 being transverse to the borehole 12, 14, which is represented by the following equation when both the transmitter and the receiver are X-directed:

$$S(\alpha) = F + A\sin^2\alpha = F + A/2 - \frac{A\cos 2\alpha}{2}, \tag{1}$$

where $\alpha$ is an angle between the direction of the receiver dipole (X) and a direction towards the remote pipe 48, and "F" and "A" are constants. The current induced in the pipe is proportional to the component of a transmitter momentum orthogonal to a direction towards the pipe, i.e., to $\sin\alpha$. Analogously, the signal S from the induced current in a receiver 46 is also proportional to $\sin\alpha$.

The signal F is the component of the signal S due to direct transmitter-receiver coupling, which is not dependent on the signal from the remote pipe 48. The constant A depends on the distance to the pipe, thus calculation of A can yield a distance to the remote pipe 48.

Thus, by making a simple two-term Fourier analysis of equation (1), for some acquired data set for different rotation phases, the constants F and A can be determined, and accordingly, distance and angle can be determined. In one embodiment, a formation resistivity "$R_t$" is also utilized in determining the constants.

In one embodiment, the dipoles of the transmitter 44 and the receiver 46 are orthogonal (e.g., one is X-directed and another is Y-directed), so the signal represented by F is substantially suppressed, and thus the signal S can be represented by:

$$S(\alpha) = A\sin\alpha\cos\alpha = \frac{A\sin 2\alpha}{2} \tag{2}$$

In one embodiment, an additional constant term $F_{res}$ is a component of the signal S, represented by residual direct coupling caused by non-perfect transmitter-receiver orthogonality due to, for example, manufacturing imperfections and tool twisting. A Fourier analysis such as subtraction of a mean value is used to filter out this component.

Referring to FIG. 4, signals representing the maximum modulus of induced EMF, i.e. $|A|/2$, from different distances from the remote pipe 48 are shown. In this example, the signals are measured versus known operational frequencies, for different values of $R_t$ and for the distances "D" of five meters and 2.5 meters (dotted lines). Curves 54, 56, 58 and 60 represent modulus values for a remote pipe distance of five meters and for resistivities of ten, one hundred, one thousand and ten thousand ohm-meters, respectively. Curves 62, 64, 66 and 68 represent modulus values for a remote pipe distance of 2.5 meters and for resistivities of ten, one hundred, one thousand and ten thousand ohm-meters, respectively.

In this example, the tool 42 is centered in a borehole having an 8.5 inch diameter that is filled with an oil-based mud or drilling fluid. The remote component, such as the pipe 48, diameter is also 8.5 inches. The calculations are conducted for frequencies ranging from 1 kHz to 2 MHz, for formation resistivities from 10 to $10^4$ ohmm, and for distance to the ranged pipe of 2.5 meters and 5 meters. In this example, the formation 16 includes oil sands and has an average resistivity $R_t$ of 100 ohmm.

In this example, it can be seen that for low frequencies, i.e., less than approximately 100 kHz, the signal S is too low to be reliably detected, assuming an exemplary detection threshold of 10 nV. For frequencies greater than 100 kHz, the signal is detectable. For example, for $R_t$=100 ohmm, D=5 m, and frequency f=1 MHz, the signal is 140 nV.

The obtained set of results, for frequencies>100 kHz and $R_t$<1,000 ohmm, is approximately represented by the following semi-empirical formula:

$$|S| \approx CR_t^{-1/2}D^{-2}\omega^2\exp\left(-\frac{2D}{L_{skin}}\right), \tag{3}$$

where $$L_{skin} = \sqrt{\frac{2R_t}{\omega\mu_t}}.$$

In this equation, "C" is a tool constant, $\omega=2\pi f$, and "$\mu_t$" is the formation permeability. As shown, the dependence of the signal on the distance D is a product of two multipliers: a "geometric" multiplier $D^{-2}$ and a skin-effect factor $$\exp\left(-\frac{2D}{L_{skin}}\right).$$

The distance D can be derived based on this equation from an acquired signal having a known resistivity.

It follows from formula (3) and the calculated data for $R_t$=100 ohmm, D=5 m, that the signal threshold 10 nV is achieved, in this example, when D≈9 m. Accordingly, in this example, for frequency of approximately 1 MHz and the exciting current 2 A, a distance D can be derived from a signal from a component up to approximately 9 meters away from the receiver 46.

The angular behavior of the signal S, represented by equation (2), can be caused not only by a remote conductive pipe 48 but also by deviations from azimuthal symmetry of a formation. Use of two-coil bucking, i.e., inclusion of the bucking coil 52, significantly reduces the signal resulting from asymmetry.

Figure 5:
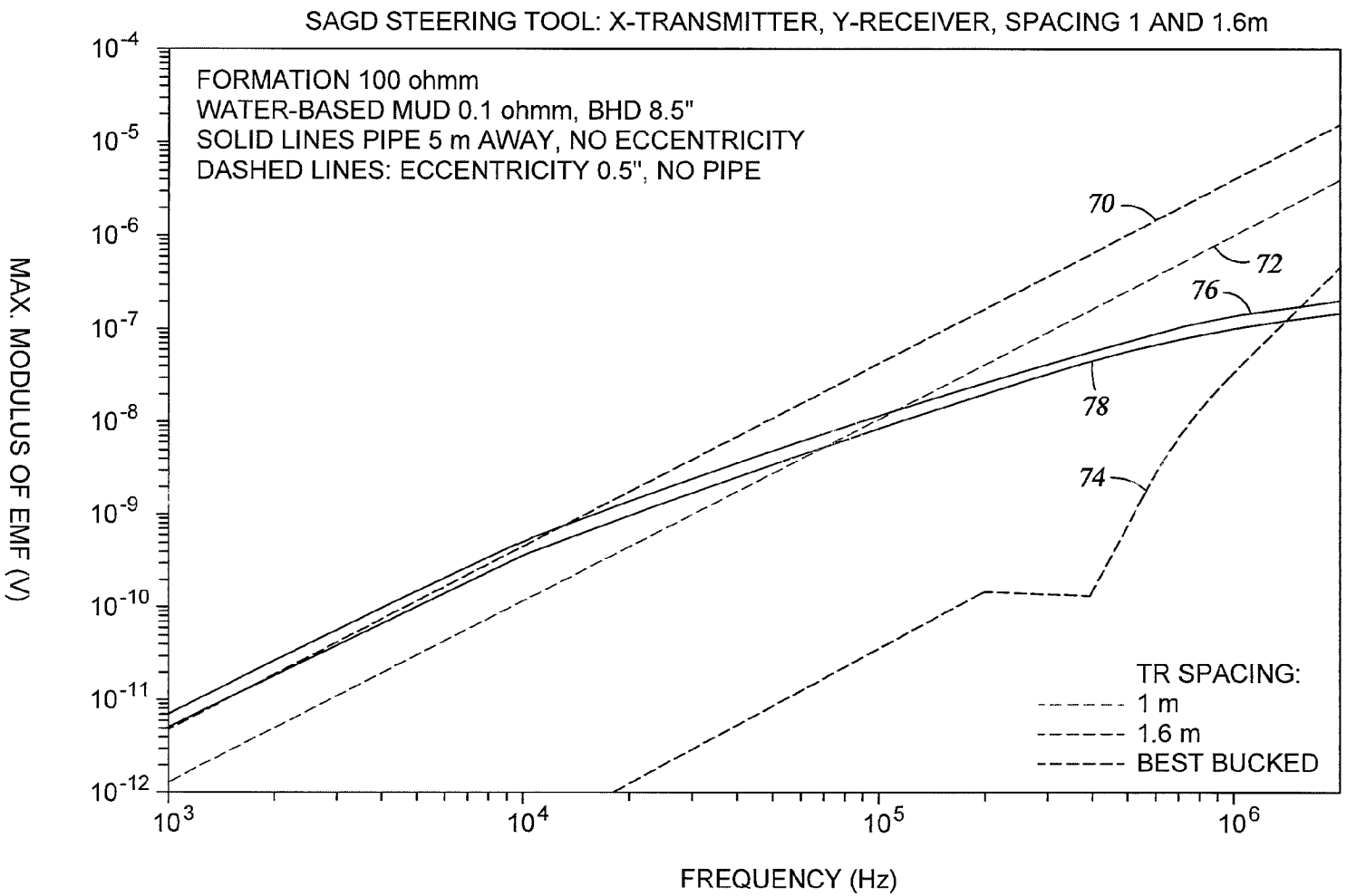
FIG. 5 depicts exemplary signal values demonstrating an inclusion of a bucking coil.

Referring to FIG. 5, exemplary measurements of magnetic field signals for both unbucked (i.e., no bucking coil 52) and bucked (i.e., inclusion of the bucking coil 52) are shown. FIG. 5 demonstrates that using the bucked configuration yields a signal that is very close to a signal representing only the remote pipe 48.

In this example, the bucked configuration of the tool 42 includes two receivers, i.e., the receiver 46 and the bucking coil 52, spaced from the X-transmitter 44 by 1 meter and 1.6 meters, respectively. The unbucked configuration does not include the bucking coil 52. The range of frequencies applied is between 1 kHz to 2 MHz, the formation resistivity is 100 ohmm, and the borehole has a 8.5 inch diameter and is filled with conductive mud having a resistivity of 0.1 ohmm.

Two formation examples are represented. The curves 70 and 72 represent a signal from the formation 16 with no remote pipe 48 present using the tool 42 in the unbucked configuration with 0.5 inch eccentricity. The curve 74 represents a signal from the formation 16 with no remote pipe 48 present using the tool 40 in the bucked configuration with 0.5 inch eccentricity.

The curve 76 represents a signal from a formation with a remote pipe 48 five meters away, using the tool 40 in the unbucked configuration with no eccentricity and a spacing between the transmitter 42 and the receiver 44 of one meter and 1.6 meters. The curve 78 represents a signal from the formation 16 with a remote pipe 48 five meters away, using the tool 42 in the bucked configuration with no eccentricity.

FIG. 5 demonstrates that the signal from the eccentered borehole is approximately inversely proportional to $L^3$, where "L" is the spacing distance between the bucking coil 52 and the receiver 46. Thus, in this example, the bucking configuration greatly suppresses the parasitic borehole signal while the useful pipe signal loses only about 25% of its value.

The signal from the tool 42 in the bucked configuration, in one embodiment, is represented by the equation:

$$S=S_{long}-aS_{short}, \tag{4}$$

where $S_{long}$ is the component of the signal S from the receiver 46 and $S_{short}$ is the component of the signal S from the bucking coil 52, "a" is a bucking coefficient chosen to minimize an undesirable component of a signal. A proper choice of a could completely eliminate the parasite signal, but in practice effectiveness of the elimination is limited by precision of a calibration, by accuracy of measurements, and by stability of electronics.

In one embodiment, a frequency of the transmitted signal is selected based on the equation (3). The equation (3) is a function of the signal modulus versus frequency, for some given formation resistivity $R_t$ and distance to the pipe D. The signal S has a maximum at the point where the skin-effect attenuation overwhelms the $\omega^2$ growth of the signal. Solving the equation for:

$$\frac{\partial|S|}{\partial\omega}=0,$$

the maximum is reached when the following is satisfied:

$$D=2L_{skin}=2\sqrt{\frac{2R_t}{\omega\mu_t}}, \tag{5}$$

or $$\omega=\frac{8R_t}{\mu_t D^2}.$$

In this embodiment, selecting an optimal desired frequency includes selecting a desired maximum distance D. For example, assuming that the maximum distance D is 10 meters, and $R_t$=100 ohmm, the optimal frequency is calculated to be approximately 1 MHz.

Figure 6:
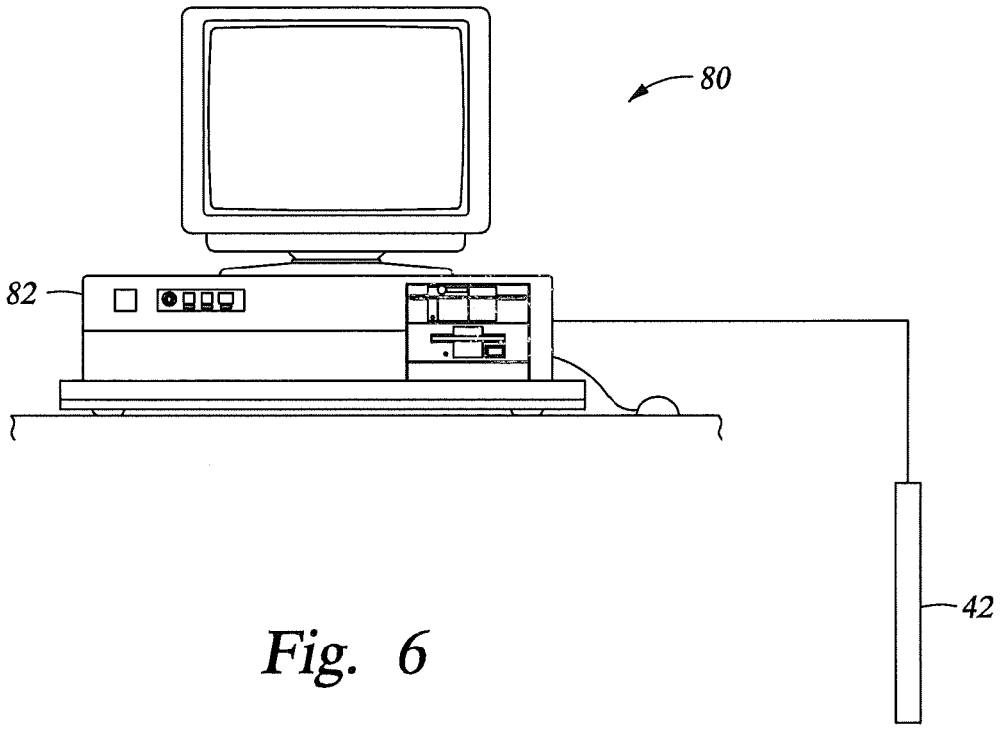
FIG. 6 depicts an exemplary embodiment of a system for detecting a position of a component in an earth formation.

Referring to FIG. 6, there is provided a system 80 for measurement of a temperature and/or composition used in conjunction with the tool 42. The system 80 may be incorporated in a computer or other processing unit capable of receiving data from the tool 60. The processing unit may be included with the tool 42 or included as part of a surface processing unit.

In one embodiment, the system 80 includes a computer 82 coupled to the tool 60. Exemplary components include, without limitation, at least one processor, storage, memory, input devices, output devices and the like. As these components are known to those skilled in the art, these are not depicted in any detail herein. The computer 82 may be disposed in at least one of the surface processing unit and the tool 42.

Generally, some of the teachings herein are reduced to an algorithm that is stored on machine-readable media. The algorithm is implemented by the computer 82 and provides operators with desired output.

Figure 7:
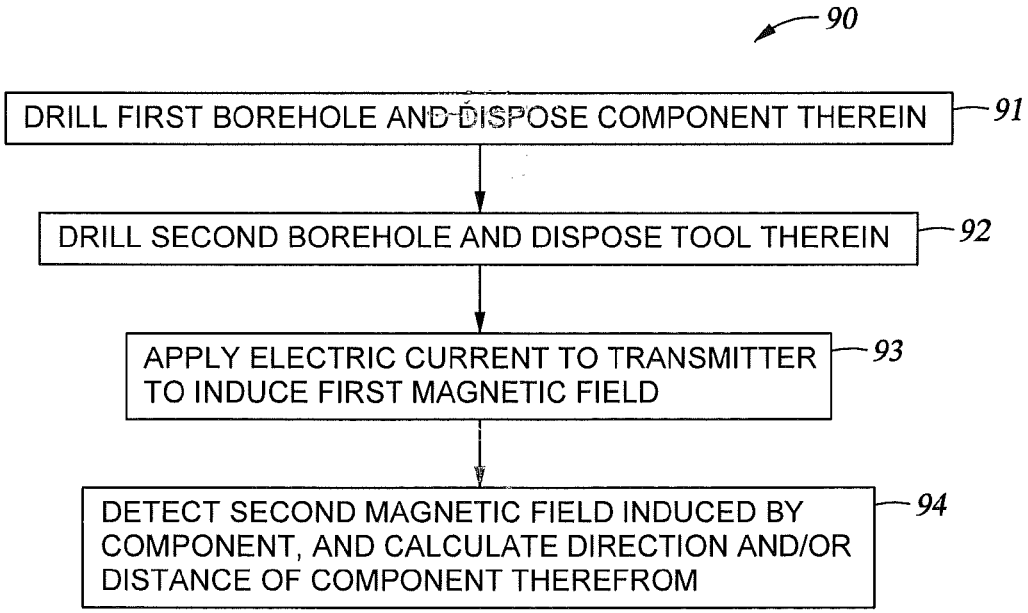
FIG. 7 depicts a flow chart providing an exemplary method of detecting a position of a component in an earth formation.

FIG. 7 illustrates a method 90 for measuring a temperature and/or a composition of an earth formation. The method 90 includes one or more of stages 91-94 described herein. The method may be performed continuously or intermittently as desired. The method is described herein in conjunction with the tool 42, although the method may be performed in conjunction with any number and configuration of processors, sensors and tools. The method may be performed by one or more processors or other devices capable of receiving and processing measurement data, such as the microprocessor and/or the computer 82. In one embodiment, the method includes the execution of all of stages 91-94 in the order described. However, certain stages 91-94 may be omitted, stages may be added, or the order of the stages changed.

In the first stage 91, the borehole 12 is drilled. An electrically conductive component, for example, a component of a drillstring, is lowered into the borehole 12 during or after drilling.

In the second stage 92, the second borehole 14 is drilled, and the tool 42 is lowered into the borehole 14 during drilling. In one embodiment, the tool 42 is disposed in a portion of a drillstring, for example, in a bottomhole assembly (BHA).

In the third stage 93, an electric current having a selected frequency is applied to the transmitter 44, which transmits a first magnetic field from the transmitter 44 to induce an electric current in the component and an associated second magnetic field.

In one embodiment, the selected frequency is determined based on the average resistivity of the formation 16 and a selected maximum distance. For example, the selected frequency is determined based on equation (5).

In the fourth stage 94, the receiver detects the second magnetic field and generates data representing the second magnetic field. The direction and/or distance of the component is calculated. For example, the direction and/or the distance is calculated based on equations (1) and/or (2). In another example, the distance is calculated based on equation (3). In one embodiment, calculating the direction and/or distance includes performing a Fourier analysis on the data such as by subtraction of a mean value of the data.

In another embodiment, the downhole measurement tool 42 maybe used to estimate a position of the first borehole 12 with respect to the second borehole 14 while the second borehole 14 is being drilled. In this embodiment, the downhole measurement tool 42, which may be referred to as a position sensing device, is disposed at a drill string drilling the second borehole 14. The position sensing device transmits a first signal towards the first borehole 12 and receives a second signal indicative of the position of the second borehole 14 relative to the first borehole 12. The second signal is affected by the first borehole 12 and/or materials at the first borehole 12. The first signal and/or the second signal include information related to the position of the first borehole 12. In one embodiment, the information is related to a distance and/or an azimuth from the second borehole 14 to the first borehole 12.

In an alternative embodiment, the position sensing device can be located in the first borehole 12. In this embodiment, the position sensing device can estimate the position of the second borehole 14 being drilled with respect to the first borehole 12. Further in this embodiment, the position locating tool may be conveyed by a wireline, slickline or tubular as non-limiting examples.

The position sensing device can transmit the location information to a drilling control system. The drilling control system is configured to geosteer the drillstring that is drilling the second borehole 14. Thus, the second borehole 14 may be drilled at a selected distance from the first borehole 12.

Figure 8:
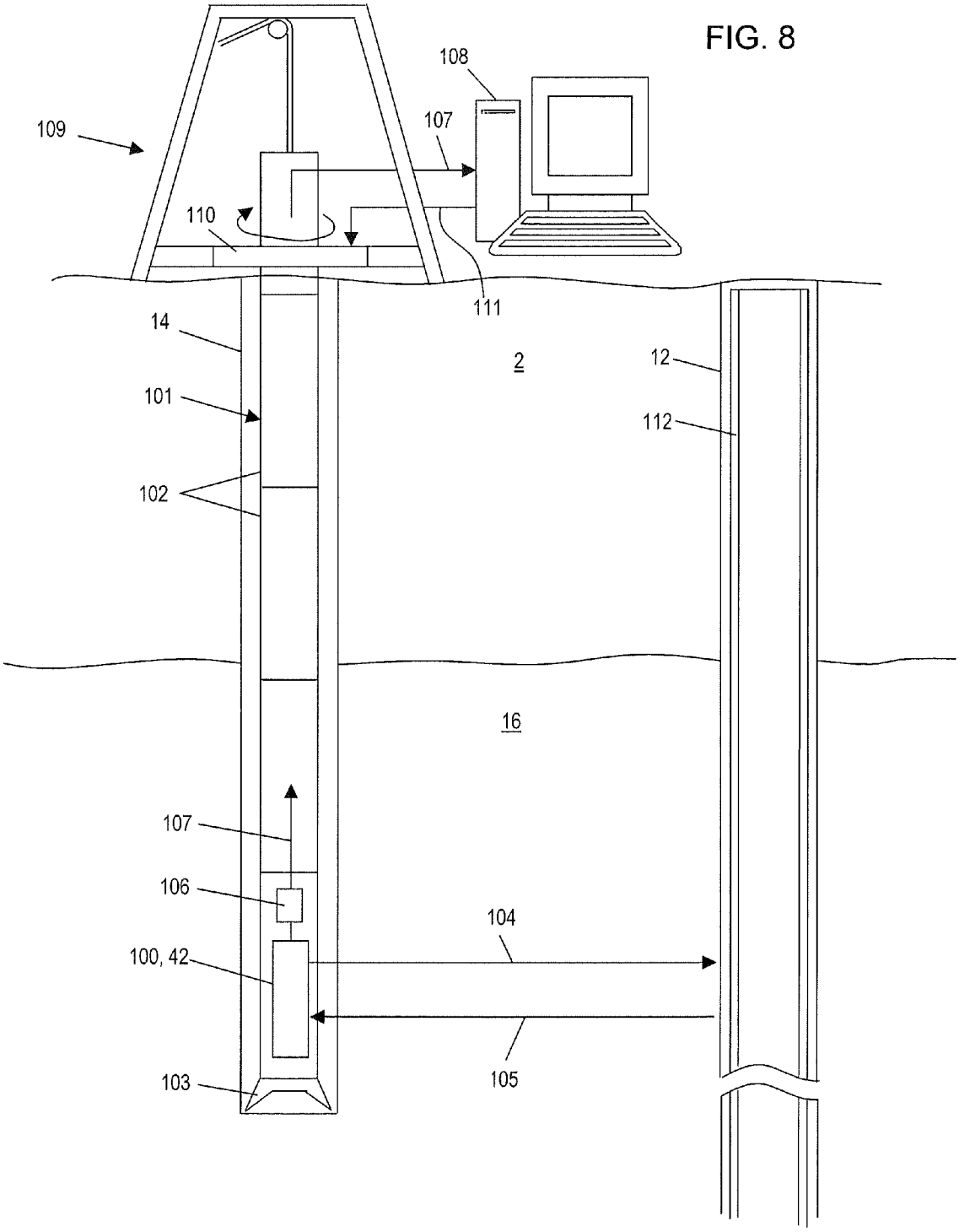
FIG. 8 depicts aspects of drilling a second borehole relative to a first borehole.

Reference may now be had to FIG. 8. FIG. 8 depicts aspects of drilling the second borehole 14 into Earth 2 relative the first borehole 12. The Earth 2 includes the earth formation 16 and any subsurface materials as may be present such as fluids, gases, liquids, and the like. In this example, the second borehole 14 is drilled into the Earth 2 using a drill string 101 driven by a drilling rig 109, which, among other things, provides rotational energy, downward force and geosteering capabilities. A drilling control system 110 is configured to control components of the drilling rig 109 to geosteer drilling of the second borehole 14. The drill string 101 includes lengths of drill pipe 102 which drive a drill bit 103. The drill string 101 and the drill bit 103 may be referred to as a drilling tool. In this example, a position sensing device 100, which maybe the downhole measurement tool 42, is disposed in the vicinity of the distal end of the drill string 101.

In the embodiment of FIG. 8, the first borehole 12 has disposed therein a conductive tubular 112. The tubular 112 represents a material disposed in the first borehole 12 that may be sensed by the position sensing device 100.

Still referring to FIG. 8, a downhole electronics unit 106 is configured to process position measurements performed by the position sensing device 100 to estimate the position of the second borehole 12 and to transmit the estimated position to a surface processing system 108 as data 107. Alternatively, the position measurements may be transmitted as the data 107 to the surface processing system 108 for the processing. In one embodiment, the surface processing system 108 is configured to provide a control signal 111 to the drilling control system 110 to geosteer the drilling of the second borehole 14.

The position sensing device 100 is configured to transmit a first signal 104 towards the first borehole 12. A second signal 105 is returned to the position sensing device after interacting with the first borehole 12 or material at the first borehole 12. The second signal 105 by itself or in combination with the first signal 104 includes information for estimating the position of the second borehole 14 relative to the first borehole 12. The information can be derived from a signal intensity, a difference in signal intensities, signal travel time or time delays, and/or a signal phase shift as non-limiting examples. The second signal 105 may be returned in various ways depending on the nature of the first signal 104.

In one embodiment, the first signal 104 is reflected by the first borehole 12 and/or a material at the first borehole 12 to form the second signal 105. An acoustic signal is one non-limiting example of a signal that may be reflected. Accordingly, in this embodiment, an acoustic tool may be used as the position sensing device 100.

In another embodiment, the first signal 104 energizes a material at the first borehole 12 causing the material to transmit the second signal 105. An electromagnetic signal is one non-limiting example of a signal that will cause the material to transmit another signal. For example, the electromagnetic signal (i.e., the first signal 104) can induce an electrical circulating current in the material. The electrical circulating current in turn transmits another electromagnetic signal represented by the second signal 105. Accordingly, in this embodiment, an electromagnetic tool, such as the downhole measurement tool 42, may be used as the position sensing device 100. In general, the material at the first borehole 12 in this embodiment is a conductor such as a metal, which may be in a tubular or component disposed in the first borehole 12.

In yet another embodiment, the first borehole 12 and/or a material at the first borehole 12 alters or modifies the first signal 104 resulting in the second signal 105. An electric current is one non-limiting example of a signal in this embodiment. A first electrode can be used to inject electrical current (i.e., the first signal 104) into the formation 16. In general, a "bucking" current may also be injected by another electrode to force the injected current towards the first borehole 12. A second electrode sufficiently spaced from the first electrode receives the return current (i.e., the second signal 105). The first borehole 12 and/or a material in the first borehole 12 can form an impedance to the injected and return currents, which can be related to the position of the second borehole 14 with respect to the first borehole 12. Accordingly, in this embodiment, a galvanic tool may be used as the position sensing device 100. The electrodes of the galvanic tool may be disposed on a rotating mandrel in order to estimate an azimuth to the first borehole 12. The two electrodes may have different sizes and surface areas to mutually correct the measurements performed by each electrode. In order to sense the first borehole 12 at least one connection between the galvanic tool or the drill string 101 and the conductive tubular 112 disposed in the first borehole 12 may be required. In embodiments where more than two measurement electrodes are used, multiple frequencies can be used to make measurements simultaneously.

FIG. 9 presents one example of a method 120 for estimating a position of the second borehole 14 relative to a position of the existing first borehole 12 while drilling the second borehole 14. The method 120 calls for (step 121) drilling the second borehole 14 using the drilling tool 101/103 comprising the position sensing device 100 disposed thereat and configured to sense the first borehole 12. Further, the method calls for (step 122) estimating the position of the second borehole 14 relative to the first borehole 12 using the position sensing device 100 while the second borehole 14 is being drilled. The estimating may also be performed during a temporary halt in drilling.

The apparatuses and methods described herein provide various advantages over prior art techniques. The apparatuses and methods allow for substantial reduction or elimination of signals from direct coupling between the transmitter and the receiver and from asymmetry of the downhole tool. The systems and methods thus provide a high quality signal representing the remote pipe or other component.

In support of the teachings herein, various analyses and/or analytical components may be used, including a digital and/or an analog system. For example, the downhole electronics unit 106 or the surface processing system 108 may include the digital and/or analog system. The system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Further, various other components may be included and called upon for providing aspects of the teachings herein. For example, a sample line, sample storage, sample chamber, sample exhaust, pump, piston, power supply (e.g., at least one of a generator, a remote supply and a battery), vacuum supply, pressure supply, refrigeration (i.e., cooling) unit or supply, heating component, motive force (such as a translational force, propulsional force or a rotational force), magnet, electromagnet, sensor, electrode, transmitter, receiver, transceiver, controller, optical unit, electrical unit or electromechanical unit may be included in support of the various aspects discussed herein or in support of other functions beyond this disclosure.

The term "carrier" as used herein means any device, device component, combination of devices, media and/or member that may be used to convey, house, support or otherwise facilitate the use of another device, device component, combination of devices, media and/or member. Exemplary non-limiting carriers include drill strings of the coiled tube type, of the jointed pipe type and any combination or portion thereof. Other carrier examples include casing pipes, wirelines, wireline sondes, slickline sondes, drop shots, bottom-hole-assemblies, drill string inserts, modules, internal housings and substrate portions thereof.

Elements of the embodiments have been introduced with either the articles "a" or "an." The articles are intended to mean that there are one or more of the elements. The terms "including" and "having" are intended to be inclusive such that there may be additional elements other than the elements listed. The conjunction "or" when used with a list of at least two terms is intended to mean any term or combination of terms. The terms "first" and "second" are used to distinguish elements and are not used to denote a particular order. The term "at" is inclusive of the terms "in" and "on."

One skilled in the art will recognize that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for estimating a position of a second borehole relative to an existing first borehole, the method comprising:

conveying a position sensing device with a drilling tool in the second borehole, the position sensing device being configured to sense the first borehole;

transmitting a first signal from the position sensing device towards the first borehole, the first signal comprising a type of energy;

receiving a second signal with the position sensing device in response to the first signal interacting with the first borehole or material at the first borehole, the second signal comprising the same type of energy as the first signal; and estimating the position of the second borehole relative to the first borehole using the position sensing device;

wherein the second signal comprises information indicative of the position of the second borehole relative to the first borehole.

2. The method of claim 1, wherein the estimating is performed while drilling the second borehole with the drilling tool.

3. The method of claim 1, wherein the estimating is performed during a halt in drilling the second borehole with the drilling tool.

4. The method of claim 1, wherein the first signal and the second signal comprise acoustic energy.

5. The method of claim 1, wherein the first signal and the second signal comprise electromagnetic energy.

6. The method of claim 1, wherein the first signal and the second signal comprise electric current.

7. The method of claim 1, wherein the information comprises as least one selection from a group consisting of intensity, travel time, and phase shift.

8. The method of claim 7, further comprising comparing the information to the first signal.

9. The method of claim 1, further comprising transmitting the position to a drilling control system to geosteer drilling the second borehole.

10. The method of claim 1, wherein a conductive tubular is disposed in the first borehole.

11. A method for estimating a position of a second borehole relative to a first borehole, the method comprising:

conveying a carrier comprising a position sensing device disposed thereat through the second borehole;

transmitting a first signal from the position sensing device towards the first borehole, the first signal comprising a type of energy;

receiving a second signal with the position sensing device in response to the first signal interacting with the first borehole or material at the first borehole, the second signal comprising the same type of energy as the first signal; and estimating the position of the second borehole relative to the first borehole using the second signal;

wherein the first signal and the second signal comprise at least one of electromagnetic energy and electric current.

12. The method of claim 11, further comprising transmitting the position to a drilling control system to geosteer drilling one of the first borehole and the second borehole.

13. An apparatus for estimating a position of a second borehole relative to a first borehole, the apparatus comprising:

a carrier configured for being conveyed through the second borehole; and a position sensing device disposed at the carrier and configured to sense the first borehole to estimate the position of a second borehole relative to the first borehole by transmitting a first signal comprising a type of energy from the position sensing device towards the first borehole and receiving a second signal comprising the same type of energy as the first signal in response to the first signal interacting with the first borehole or material at the first borehole;

wherein the position sensing device emits and receives signals comprising at least one of electromagnetic energy and electric current to sense the first borehole.

14. The apparatus of claim 13, wherein the carrier comprises at least one of a wireline, a slickline, coiled tubing, and a drill string.

15. The apparatus of claim 13, further comprising a drilling control system configured to receive the estimated position to geosteer drilling of one of the first borehole and the second borehole.

16. The apparatus of claim 13, wherein the position sensing device comprises at least one electrode configured to rotate about the device and to measure the electric current.

* * * * *